US010676879B2

(12) United States Patent
Laugwitz

(10) Patent No.: US 10,676,879 B2
(45) Date of Patent: Jun. 9, 2020

(54) METHOD FOR MONITORING COMPACTION PROCESS IN ROAD CONSTRUCTION AND ROAD ROLLER

(71) Applicant: BOMAG GmbH, Boppard (DE)

(72) Inventor: Niels Laugwitz, Boppard (DE)

(73) Assignee: BOMAG GmbH, Boppard (DE)

( * ) Notice: Subject to any disclaimer, the term of this patent is extended or adjusted under 35 U.S.C. 154(b) by 3 days.

(21) Appl. No.: 16/127,549

(22) Filed: Sep. 11, 2018

(65) Prior Publication Data

US 2019/0078270 A1 Mar. 14, 2019

(30) Foreign Application Priority Data

Sep. 13, 2017 (DE) ..... 10 2017 008 602

(51) Int. Cl.
*E01C 19/28* (2006.01)
*E01C 19/23* (2006.01)
*E01C 19/00* (2006.01)

(52) U.S. Cl.
CPC ..... *E01C 19/288* (2013.01); *E01C 19/004* (2013.01); *E01C 19/23* (2013.01)

(58) Field of Classification Search
CPC ..... E01C 19/288; E01C 19/004; E01C 19/23; E01C 19/48
See application file for complete search history.

(56) References Cited

U.S. PATENT DOCUMENTS 5,942,679 A * 8/1999 Sandstrom ..... E01C 19/26 404/133.05
6,749,364 B1 * 6/2004 Baker ..... E01C 19/288 404/118

(Continued)

FOREIGN PATENT DOCUMENTS

DE 69434631 T2 8/2006
DE 102007019419 A1 10/2008

(Continued)

OTHER PUBLICATIONS

European Patent Office, Extended European Search Report, Application No. 18000716.3, dated Feb. 15, 2019 (5 pages).

(Continued)

*Primary Examiner* — Abigail A Risic
(74) *Attorney, Agent, or Firm* — Wood Herron & Evans LLP

(57) ABSTRACT

A method for monitoring the compaction process of an asphalt layer to be compacted in road construction is provided comprising the steps: detecting the edges limiting the hot asphalt layer transversely to the road pathway by means of a temperature sensor arranged on a road roller compacting the asphalt layer, and dividing the detected asphalt layer into at least two width segments across the road pathway, wherein the position of the road roller on the asphalt layer transversely to the road pathway is determined from the measurement of the temperature sensor and is assigned to one of the width segments, the working operation of the road roller on the width segment is quantified via an operating parameter and stored, and the quantified working operation for each width segment is displayed to the operator for at least one past working interval. A road roller for carrying out the method is also provided.

13 Claims, 5 Drawing Sheets

(56) References Cited

U.S. PATENT DOCUMENTS

| | | | | |
|---|---|---|---|---|
| 9,587,361 | B2 * | 3/2017 | Oetken | E02D 3/074 |
| 10,371,655 | B2 * | 8/2019 | Delius | G01J 5/0022 |
| 2008/0063473 | A1 * | 3/2008 | Congdon | E01C 19/288 404/75 |
| 2008/0260462 | A1 | 10/2008 | Ackermann | |
| 2010/0087992 | A1 * | 4/2010 | Glee | E01C 19/288 701/50 |
| 2015/0167257 | A1 * | 6/2015 | Korb | E02D 3/02 404/76 |
| 2015/0211199 | A1 * | 7/2015 | Corcoran | E02D 1/00 404/122 |
| 2016/0042235 | A1 * | 2/2016 | Buschmann | G06T 7/0004 348/148 |
| 2016/0076205 | A1 * | 3/2016 | Corcoran | E01C 19/288 73/784 |
| 2017/0284036 | A1 * | 10/2017 | Rio | E01C 19/288 |
| 2017/0322088 | A1 * | 11/2017 | Becher | E01C 19/48 |

FOREIGN PATENT DOCUMENTS

| | | | |
|---|---|---|---|
| DE | 102012208554 | A1 | 11/2013 |
| DE | 102016002064 | A1 | 8/2016 |
| DE | 112015000363 | T5 | 10/2016 |
| EP | 1876297 | A2 | 1/2008 |
| WO | 9425680 | A1 | 11/1994 |
| WO | 0070150 | A1 | 11/2000 |

OTHER PUBLICATIONS

German Patent Office, Search Report, Application No. 102017008602.8, dated Jul. 10, 2018 (7 pages).

* cited by examiner

METHOD FOR MONITORING COMPACTION PROCESS IN ROAD CONSTRUCTION AND ROAD ROLLER

CROSS-REFERENCE TO RELATED APPLICATION

The present application claims priority under 35 U.S.C. § 119 of German Patent Application No. 10 2017 008 602.8, filed Sep. 13, 2017, the disclosure of which is hereby incorporated herein by reference in its entirety.

FIELD OF THE INVENTION

The present invention relates to a method for monitoring the compaction process of an asphalt layer to be compacted in road construction. Moreover, the invention relates to a road roller, in particular a tandem roller, a single-drum roller or a rubber-tired roller, for carrying out the method.

BACKGROUND OF THE INVENTION

In road construction, hot asphalt is usually distributed transversely across the width of an intended road pathway before being smoothed and precompacted by a road paver, e.g., with a tamper beam and/or a paving screed. Further, while the asphalt material is still hot and plastic, the new road surface is usually further compacted by road rollers following the road paver, said road rollers being configured, e.g., as tandem rollers, single-drum rollers or rubber-tired rollers. A road will reach its maximum life span only at an optimum degree of compaction. Insufficient or excessive compaction both result in a reduced durability of the road surface and thus in a reduced quality of the finished road. For road construction projects, the operators of the road rollers generally define rolling patterns adapted to the asphalt layer to be compacted, including the sequence and the number of passages to be performed, in order to achieve a compaction of the asphalt layer that is as even as possible. Just how even the compaction of the entire road surface ultimately turns out depends largely on how strictly the operators of the road rollers adhere to the provided rolling pattern. The objective of these rolling patterns is to compact the road surface as evenly as possible over its width and length.

Adherence to the rolling pattern is, however, not the only aspect with respect to which the road roller operators need to be careful. For example, they also need to coordinate with other rollers and keep an eye on the progress of the road paver. Moreover, these rollers need to be guided particularly precisely in the edge region of the asphalt layer, since they are also supposed to create a straight, sharp road edge by means of, e.g., pressure rollers attached to the sides of the road rollers. It is thus possible that certain regions of the asphalt layer to be compacted are compacted more than others during a working operation. For example, it frequently occurs that the road roller operators pass over the edge areas of the asphalt layer less often than the areas in the middle. This results in an uneven compaction of the road and thus in a poorer quality of the finished road surface layer.

Several strategies are known in the prior art to ensure an optimal compaction of the asphalt layers. For example, systems are known in which it is possible by means of a global positioning system (GPS) to track with maximum precision which parts of the asphalt layer have already been compacted by the road rollers and which parts require further compaction. Systems are known in which the entire construction site is mapped in this manner and displayed to the operator of the road roller as a three-dimensional topography with different colors indicating areas with different degrees of compaction. In order to render a sufficiently precise positioning of the road roller possible, elaborate and expensive equipment is needed. U.S. Pat. No. 6,749,364 B1 discloses a system in which the road rollers are equipped with a thermal imaging camera which generates a thermal profile of the asphalt layer laid by the road paver and which displays the thermal profile to the road roller operator so that the latter knows where the asphalt layer currently has an optimal temperature for compaction. The rolling pattern is thus adapted here to the actual conditions in terms of the current temperature of the asphalt layer. In U.S. Pat. No. 6,749,364 B1, the position of the roller is also determined by means of GPS- or laser-based systems, e.g., calibrated total stations.

A disadvantage of the systems according to the prior art is that they require more elaborate technical equipment and involve increased acquisition costs and, in some cases, even increased operating costs. Moreover, when deviating from the planned rolling pattern as a result of the temperature profile of the asphalt layer, there is a risk that different areas will be compacted to different degrees.

An object of the present invention is thus to provide a method and a road roller with which the compaction process of an asphalt layer to be compacted in road construction is successfully monitored, so that the overall compaction quality can be improved. At the same time, the operator of the road roller is to be relieved of the burden of a rigorous monitoring of the adherence to the rolling pattern, so that he can concentrate on steering the road roller. Another object of the present invention is the successful monitoring of the compaction process with minimum technical expenditure and thus in a particularly cost-effective manner.

SUMMARY OF THE INVENTION

Specifically, the present invention is achieved with a method for monitoring the compaction process of an asphalt layer to be compacted in road construction, comprising the steps: detecting the edges limiting the hot asphalt layer across the road path by means of a temperature sensor arranged on a road roller compacting the asphalt layer, and dividing the detected asphalt layer into at least two width segments across the road path. The width segments are respectively defined by their distance from the edges of the asphalt layer. According to the present invention, the position of the road roller on the asphalt layer across the road path is determined from the measurement of the temperature sensor and assigned to one of the width segments, the working operation of the road roller on the width segment in question is quantified and stored by means of an operating parameter, and the quantified working operation for each road segment is indicated, in particular to the road roller operator, for at least one past working interval. An aspect of the present invention is the creation of a simple system that provides the operator of the road roller with an overview, i.e., with respect to whether the preceding work steps have been distributed evenly across the entire width of the asphalt layer to be compacted or whether one region of the width of the asphalt layer to be compacted has been compacted to a larger or lesser extent than other regions. Unlike the prior art, however, this is to be accomplished without a complicated and expensive mapping of the entire working area. Instead, it is merely to be ascertained and indicated to the operator of the road roller how evenly the work of the road roller has been distributed across the entire width of the asphalt layer during a working interval just completed, so that the operator may adjust the procedure if it turns out that the asphalt layer would otherwise be compacted unevenly. Ultimately, this means counting how long and/or how often the roller is located in one of the defined width segments. Accordingly, the current position of the road roller needs to be known and documented with respect to the width of the asphalt layer to be compacted only. It is not necessary to know the position of the road roller in the longitudinal direction of the road pathway as well. The longitudinal direction of the road pathway here refers to the longitudinal extension of the pavement to be compacted by the roller in the working direction/direction of progress of the road paver. For compaction purposes, however, the roller is normally moved over the road pavement in a reversing pattern in and against this working direction/direction of progress. The aim is usually to perform more than one passage with the roller in order to obtain a desired compaction result.

In practice, a road paver lays the asphalt layer to be compacted more or less continuously in its forward working direction. The road rollers following the road paver then drive over the freshly laid asphalt, following the defined rolling pattern as far as possible by means of frequent passages back and forth. The working area of the road rollers thus also moves forward in an essentially continuous manner, i.e., the road rollers advance together with the road paver, which moves at a considerably lower speed, during the paving process. According to one embodiment of the present invention, the temperature sensor is used to detect the width segment of the asphalt layer in which the road roller is currently compacting the asphalt. These data are stored for at least one working interval and undergo statistical evaluation, so that it can be indicated to the operator which share of the compaction work has been performed in which width segment during the working interval. If the operator of the road roller adheres to the rolling pattern strictly, all of the width segments should have been compacted evenly. A deviation from this even distribution—e.g., because the road roller has driven over the asphalt layer in one width segment more often than in another width segment—would thus be indicated to the operator by an uneven distribution of the compaction work between the width segments, so that the operator can make adjustments in order to avoid an uneven compaction during the subsequent working operation.

The present invention utilizes the fact that asphalt is laid by road pavers in a hot state. This always results in a large difference in temperature between the laid asphalt layer to be compacted and the ground adjacent to the asphalt layer, which is significantly colder than the asphalt. This can be utilized by the temperature sensor according to the present invention, which is, in particular, a contactless temperature sensor, in order to determine the location of the edges of the hot asphalt layer, i.e., the position of the border between the hot asphalt layer and the cold ground next to the road pathway, as well as the position of the roller mathematically as a function of at least one detected lateral edge, in particular by means of a suitable control unit. Accordingly, the temperature sensor according to the present invention is configured so as to facilitate the detection of a temperature of the asphalt layer within a width that is broader than the width of the drum of the road roller. Once the temperature sensor has determined the edges of the asphalt layer, which extend in a direction parallel to the longitudinal extension of the road, the asphalt layer can be mathematically divided into width segments across the road pathway. Moreover, since the position of the temperature sensor on the road roller is known, the current position of the road roller can be assigned to one of the width segments based on the continuous measurement by the temperature sensor. In other words, the position of the road roller is determined in relation to the width of the asphalt layer to be compacted. The present invention thus utilizes the fact that the position of the road roller transversely to the road pathway can be determined based on the measurements performed by the temperature sensor. In this manner, complex and expensive systems, e.g., GPS- or laser-based systems, are not necessary. Basically, at least one detected edge region of the asphalt layer to be compacted is used to identify the position of the roller in relation to the width of the asphalt layer to be compacted. The definition of the width segments, in particular the definition of the location and number of the width segments on the asphalt strip, can occur following the detection of the hot asphalt layer by the temperature sensor, as described above. However, it is also possible that initially only the position of the road roller on the asphalt layer is determined by means of the measurement performed by the temperature sensor without an immediate assignment of this position to a width segment. For example, the division into width segments and the corresponding assignment of the determined position of the road roller to the respective width segments can also occur in a subsequent evaluation step, e.g., during the statistical evaluation of the quantified working operation. The present invention is thus explicitly not limited to the aforementioned sequence of the method steps.

In order to assist the operator of the road roller with the monitoring of the progress of the compaction process, the compaction performance in a certain width segment is recorded for a past working interval in accordance with the present invention. The working operation of the road roller on the width segment is thus quantified by means of an operating parameter, as described in greater detail below. The distribution of the compaction performance or working operation of the road roller across the width segments is displayed to the operator, so that he can ensure a distribution that is as even as possible and thus achieve an even compaction of the asphalt layer.

In accordance with one embodiment of the present invention, it is sufficient to use a temperature sensor that can determine the temperature at a single point. By pivoting or moving the temperature sensor, the latter can determine the temperature along a line across the road pathway. The temperature sensor will detect a temperature jump when its measuring point traverses an edge of the asphalt layer. It can be determined by means of the movement or pivoting direction of the temperature sensor and the indication of the temperature change whether the right or the left edge of the asphalt strip has been detected. It is preferable when using such a temperature sensor that the detection of the edges limiting the hot asphalt layer across the road pathway by means of the temperature sensor occurs periodically and successively. In other words, the measurement is repeated periodically and constantly during a working operation so that the position of the edges or at least one edge of the asphalt layer to be compacted is known and thus the position of the road roller with respect to the width segments can be determined at any time. Alternatively, however, it is preferable if both edges are detected by the temperature sensor simultaneously. To this end, it is necessary for the temperature sensor to have multiple measuring points. For example, the temperature sensor can be configured as a thermal imaging camera or infrared camera with a resolution of several pixels. In this case, it is preferred that the temperature sensor, i.e., the thermal imaging camera, is arranged on the road roller in such a way that it can capture the entire width of the asphalt strip in one frame. This way, it is also particularly easy to determine the width segment in which the road roller is currently located from the image of the thermographic camera showing the edges of the asphalt strip. This is already possible with an accuracy of approximately 1 m with, e.g., thermal imaging cameras with a resolution of merely 16×4 pixels. Such thermal imaging cameras are not expensive and thus particularly suitable for the present invention.

Regardless of the specific design of the temperature sensor used, it is preferable if the measuring width of the temperature sensor corresponds to at least the width of the asphalt layer to be compacted or is even larger than the latter. For a reliable execution of the method according to the present invention, it is advantageous if the position of the roller in relation to the width of the asphalt layer to be compacted can be ascertained at any time. This is possible when one edge of the two edges of the asphalt layer is ideally constantly within the detection range or within the measuring width of the temperature sensor. In order to be able to make this possible regardless of the position of the roller within the width, the measuring width of the temperature sensor is preferably at least as large as the width of the asphalt layer to be compacted. If the roller is working in the edge region of the asphalt layer to be compacted, it is possible that only this edge is detected by the temperature sensor since the detection range is not large enough to capture the edge region that is further away. In this case, alternatively, the total width of the asphalt layer—which has already been ascertained in advance—can be used, since in most cases the paving width of the road paver does not change significantly. By means of the alternative use of the paving width, which is ascertained with the roller in a suitable position, a measuring width of the temperature sensor only slightly larger than the width of the hot asphalt layer is sufficient.

In principle, many different parameters, which are all proportional to the compaction performance or compaction work of the road roller, can be used to determine to what extent the road roller has compacted the asphalt layer, in particular statistically, in a width segment. Preferably, at least one of the following parameters is used as an operating parameter: a time period, a number of passages, a number of reversals, a traveled distance, a substrate stiffness and/or a vibration intensity of a roller drum of the road roller. The vibration intensity can be described by means of a multitude of parameters, for example, by means of the vibration amplitude, the vibration acceleration, the number of vibrations per traveled unit of distance, or centrifugal force. All of the mentioned parameters are suitable for quantifying the working operation of the road roller on a width segment. For example, it is possible to determine how much time the road roller spends on a width segment, how often it drives over a width segment or how often it changes the traveling direction on a width segment, how far the road roller has traveled on a width segment, or at which intensity a vibration exciter that causes the roller drum of the road roller to vibrate or oscillate in order to increase the compaction performance is operated. For the display to the operator, e.g., the respective parameters can be used as absolute values that are added up over time. For example, it could be indicated how much time during the preceding working interval the road roller spent on which width segments, or how far the road roller travelled on the corresponding width segments. Moreover, a relationship between the individual width segments could also be indicated. For example, the percentage of the compaction work or working performance of the road roller in the width segment in question in the past working interval could be indicated. It is naturally also conceivable to perform the quantification of the working operation via a combination of two or more of the parameters mentioned. For example, the set vibration intensity of the roller drum, which increases compaction, lends itself for combination with a further parameter. This way, the compaction performance of the road roller in the individual width segments can be weighted by the vibration intensity, which can lead to a more accurate picture of the evenness of the compaction achieved by the road roller. Alternatively, it is possible to additionally use the substrate stiffness ascertained in the respective width segments for the evaluation of the compaction performed by the roller.

According to the present invention, the past working interval refers to a past phase of the working operation. Preferably, the boundaries of the past working interval are defined using the same parameter as the one used for the quantification of the working operation and/or another parameter. This means that the past working interval comprises, for example, a certain time period, a certain number of passages, a certain number of reversing operations, and/or a certain distance traveled. Combinations of the individual parameters are naturally possible here as well. For example, the past working interval could relate to a time period of 10 minutes of the working operation of the road roller. According to one embodiment of the present invention, upon completion of a recording phase within the first 10 minutes after commencing work, an indication is given to the operator as to how, in absolute or relative terms, the working operation of the road roller was distributed between the respective width segments within these last 10 minutes. The past working interval here can relate to the same parameter (s) as the quantification of the working operation. For example, it could be indicated to the operator what percentage of the last 10 minutes of the working operation the road roller spent on the respective width segments. However, it is also possible to use different parameters for the quantification of the working operation and for defining the past working interval. For example, the working operation can be quantified by means of the number of passages whereas the past working interval relates to the time elapsed. For example, it would then be indicated to the operator what percentage of the passages of the last 10 minutes of the past working interval were performed in which width segment. All combinations of the parameters mentioned are conceivable here.

In principle, consecutive working intervals could each undergo a separate statistical evaluation, and the respective results could be indicated to the operator of the road roller, e.g., separately and successively, whenever a working interval is completed. The operator, however, only obtains hindsight information regarding potential unevenness in the compaction process this way. The parameter(s) used for the quantification of the working operation is(are) thus preferably stored during the working interval, while data antecedent to the working interval are replaced by newly captured data during the working operation. In other words, both the recording of the data and their statistical evaluation occur continuously. The past working interval thus always extends up to the present and comprises, depending on the parameter, e.g., the last 10 minutes of the working operation. The position at which the road roller is located transversely to the road pathway flows into the statistical evaluation in real time, whereas data antecedent to the predetermined working interval are removed from the statistics. The operator of the road roller can thus also monitor the development of the statistics in real time and recognize a shift occurring in the working performance of the road roller or an unevenness between the individual width segments at an early stage. This way, the driver always receives current feedback regarding the work in progress and always has an eye on the evenness of the compaction without having to concentrate on the strict adherence to the rolling pattern. Any emerging unevenness can thus be counteracted at an early stage.

The division of the detected asphalt layer into width segments can occur in different ways depending on the specific application. The aim according to the present invention is to determine the lane in which the road roller is currently located on the asphalt layer. The lane or width segment is defined by means of the distance from the cold road edge detected by the temperature sensor. Generally, a division of the asphalt layer into several width segments across the road pathway generates a higher accuracy. Moreover, the accuracy of the system is also limited by the accuracy of the temperature sensor, e.g., the number of pixels of the thermal imaging camera. In any case, the aim of the present invention is not a mapping of the asphalt layer with an accuracy within a millimeter but an orientation aid for the operator of the road roller. This does not require an exact evaluation with great accuracy. For example, the detected asphalt layer is preferably divided into at least the three width segments "left side", "middle" and "right side" across the road pathway. This way, it can be avoided that the lateral edge regions of the asphalt layer are compacted to a lesser extent than the regions in the middle of the asphalt layer. The exact number of the width segments can, e.g., also be determined based on the relation between the total width of the asphalt layer to be compacted and the width of the road roller, in particular the width of the roller drum. For example, the asphalt layer can be divided into a number of width segments corresponding to the number of times the roller drum of the road roller fits into the asphalt layer in a side-by-side arrangement while taking into account, if necessary, a typical overlap of approx. 10 cm between the different lanes. However, as mentioned above, an exact determination of the overlap width is not necessary.

According to one embodiment of the present invention, the width segments, in particular all width segments, across the road pathway are all equal in size. This way, the working operation of the road roller in the respective width segments is weighted equally for all regions of the asphalt layer. Alternatively, it is also possible that the width segments located at the edges of the detected asphalt layer are not as wide in a direction perpendicular to the road pathway as the width segments located in the middle of the detected asphalt layer. This way, a higher resolution of monitoring is attained according to the present invention, in particular at the edges of the asphalt layer. This is advantageous, in particular, when there is reason to fear that the edges of the asphalt layer are not sufficiently compacted, since only an actual working operation of the road roller in this region will then be counted for the width segments at the edges of the asphalt layer.

In order to be able to determine the position of the road roller on the asphalt layer transversely to the road pathway as precisely as possible, it is advantageous to additionally take into account various aspects of the arrangement of the temperature sensor and the working situation of the road roller. For example, a measuring angle of the temperature sensor and/or a traveling direction and/or a steering angle and/or a steering mode, e.g., a crab-steering mode, of the road roller from the measurement of the temperature sensor is preferably considered when determining the position of the road roller on the asphalt layer, in particular transversely to the road pathway. The arrangement, and thus the position, of the temperature sensor on the road roller or location of its measured region in relation to the rest of the road roller is known. The location of the area measured by the temperature sensor, in particular in relation to the road roller itself, can thus be determined from the measuring angle of the temperature sensor, which can be either adjustable or constant. In particular, when a thermal imaging camera is used, the measuring angle of the temperature sensor in relation to the asphalt layer results in a trapezoidal distortion of the thermal image produced by the thermographic camera. It is thus important to ensure when evaluating the thermal image that each pixel in the thermal image of the temperature sensor is correctly associated with the actual location on the asphalt layer or on the adjacent ground. For this purpose, each pixel of the thermal image is assigned to a coordinate across and along the traveling direction or road pathway. The measuring angle and the arrangement of the temperature sensor on the road roller are taken into account to allow for the trapezoidal perspective distortion of the thermal image so as to infer the actual position of the asphalt layer. Such calculations are known in the field of image recognition and are thus not explained in greater detail here. Often, road rollers that have an additional device, e.g., an edge pressure roller, on one side only are used. Thus, in order to be able to implement this device at both edges of the asphalt layer, the road roller is often turned 180° and driven along the asphalt layer in the opposite direction. In order to prevent confusion in the assignment of the sides, i.e., right and left, in this situation, the travelling direction also needs to be taken into account, e.g., by means of a digital compass that recognizes the current direction of travel of the road roller. By additionally taking the steering angle into account in combination with the data of the temperature sensor, it is possible to predict a change of the road roller from one width segment to another. A corresponding lane change can thus be predicted and captured more precisely than from a retrospective consideration of the measurement data of the temperature sensor. Moreover, road rollers can be operated in different steering modes. In the steering mode known as crab steering, for example, the road roller moves with the roller drums offset in parallel to each other, so that the working width of the road roller is larger. As a result, it is possible that the road roller processes, e.g., two or more width segments of the asphalt layer simultaneously, depending on the size of the width segments into which the asphalt layer has been divided. In order to take this into account in the statistics accordingly, the current steering mode of the road roller should also be included in the evaluation. The effective working width of the roller influences the optimal rolling pattern, so that the asphalt layer is preferably divided into width segments in a manner that ensures an optimum coverage of the rolling tracks. In order to assist the roller driver to the greatest extent possible, the number of necessary rolling tracks is advantageously indicated according to the paving width of the paver and the working width of the roller. The method described above can thus also be applied in such a manner that at least the total width of the area to be compacted, the distance of the road roller from at least one edge of the area to be compacted and the working width of the roller are determined. Based on these values, how the roller is to cover the area is determined statistically and subsequently assigned to a certain number of rolling lanes.

The practical execution of the method according to the present invention preferably occurs with the aid of a suitable control unit, in particular by means of suitable control software, which carries out the computations for the execution of the individual method steps in accordance with the present invention.

The object of the present invention is also achieved by means of a road roller, in particular a tandem roller, a single-drum roller or a rubber-tired roller, for compacting an asphalt layer in road construction, with a machine frame, a drive engine, a driver's cab, at least one roller drum and/or a wheel, a temperature sensor, and a control unit, wherein the control unit is configured to carry out the method according to the present invention as described above. All of the aforementioned features, effects and advantages of the method according to the present invention also apply mutatis mutandis to the road roller according to the present invention. Therefore, in order to avoid repetition, reference is made here to the descriptions made above. The control unit is configured as a central processing unit and is, e.g., integrated in the on-board computer of the road roller. It is equipped with corresponding software for the execution of the method according to the present invention.

As described above, it is preferable if the position of the road roller transversely to the road pathway is detected in a continuous manner and the evaluation statistics on the quantified working operation distributed between the width segments are updated continuously and in real time, so that the past working interval at any time extends up to the present moment and the operator always has an overview of the past working interval reaching back from that point in time. In order to execute this technically, the control unit preferably comprises a rolling memory, which stores the quantified working operation for each width segment within the past working interval. A rolling memory is characterized by the fact that it stores data up to a certain limit, in particular a limit dependent on time or storage capacity, and then deletes the oldest stored data in order to record new data in a continuous or rolling manner. In this manner, the rolling memory continuously records new data and deletes the oldest data. This way, the stored data always relate to the past working interval reaching up to the present. The statistically evaluated data from the rolling memory thus always represent the desired working interval. The size of the rolling memory is of course adapted to the desired size of the working interval.

Although various configurations of the temperature sensor can be implemented in order to carry out the present invention, it is preferable if the temperature sensor comprises a thermal imaging camera. The present invention does not place any special demands on the corresponding thermal imaging cameras, so that even very cost-effective models with a relatively low resolution can be used. A preferred resolution of the thermal imaging camera in a direction transverse to the forward direction is two and, in particular, at least four pixels.

BRIEF DESCRIPTION OF THE DRAWINGS

The present invention will now be explained in greater detail with the help of the examples shown in the figures, which show schematically.

Similar components or components with similar functions are designated by identical reference numbers in the figures. Recurring components are not designated separately in each figure.

DETAILED DESCRIPTION OF THE INVENTION

Figure 1:
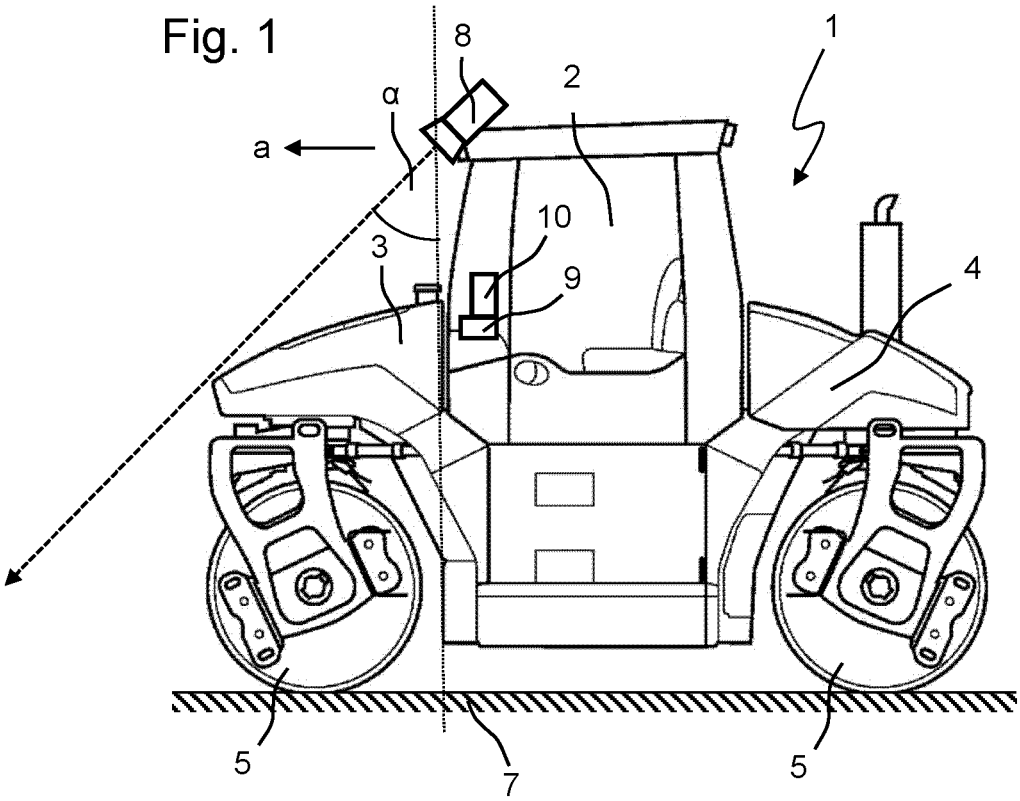
FIG. 1 is a side view of a tandem roller.
Figure 2:
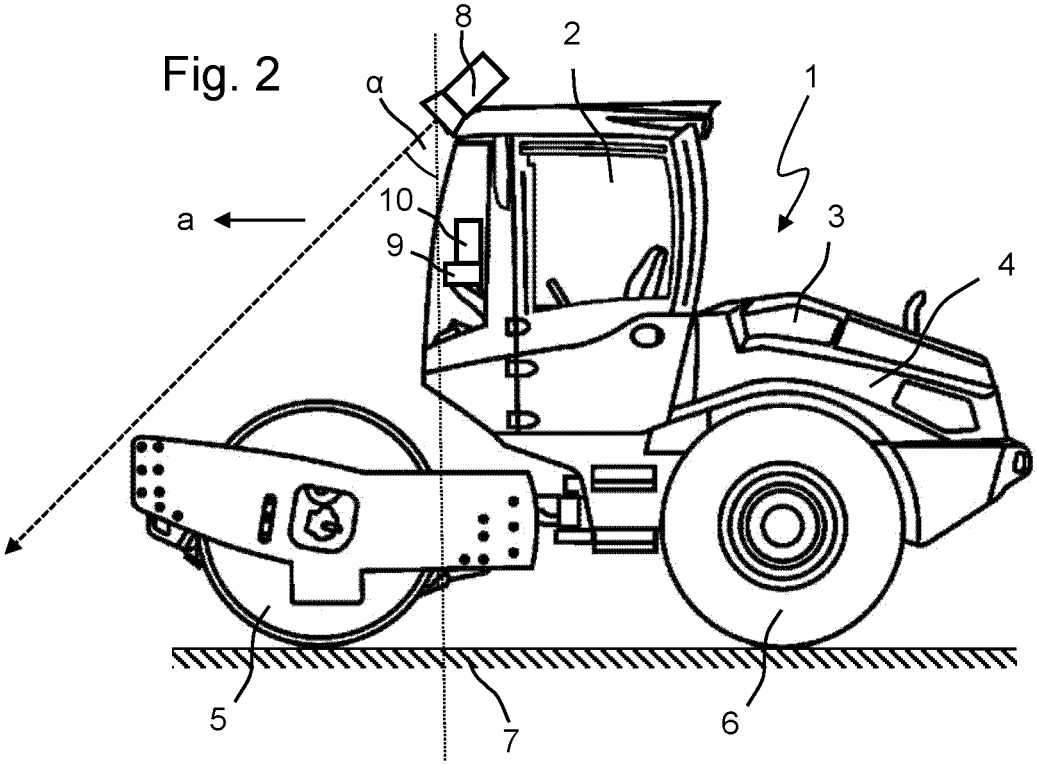
FIG. 2 is a side view of a single-drum roller.

FIGS. 1 and 2 respectively show a road roller 1 with a driver's cab 2 and a machine frame 3. Moreover, the road rollers 1 have a drive engine 4, e.g., a diesel engine. FIG. 1 shows a tandem roller moving with its two roller drums 5 over the ground 7 to be compacted during a working operation. FIG. 2 shows a single-drum roller that has a roller drum 5 and additional wheels 6 with which the single-drum roller moves over the ground 7 to be compacted. During a working operation, the road rollers 1 frequently travel back and forth, so that they compact the ground 7 whether moving forward or backward. The forward movement is referred to as the working direction a, as indicated in the figures, even if the road rollers 1 can also work in the opposite direction, merely in order to illustrate the description.

The road rollers 1 comprise a temperature sensor 8 arranged at the essentially highest point of the road rollers 1. In the embodiment shown, this is the roof of the driver's cab 2. The temperature sensors 8 are, e.g., thermal imaging cameras or infrared cameras. As indicated by the dashed arrow, the temperature sensors 8 are oriented in such a way that they capture the region ahead of the road roller 1 in the working direction a. Other arrangements and orientations of the temperature sensors 8, such as an orientation of the measured region against the working direction a, are also possible. The angle $\alpha$, at which the temperature sensor 8 is oriented in relation to the ground or vis-á-vis a plumb line, is known. The temperature sensor 8 is connected to a control unit 9, which is located, in particular, in the driver's cab 2. The control unit 9 is part of the on-board computer of the road roller 1 and is used for both the metrological as well as the statistical evaluation of the data collected by the temperature sensor 8. Moreover, the control unit 9 is connected to a display device 10, by means of which the statistical evaluation of the distribution of the quantified working operation between the width segments of the asphalt strip can be displayed to the operator of the road roller 1. Naturally, the control unit 9 can also transmit the evaluated data via a cable or wireless connection to a further terminal, e.g., a smartphone or a tablet computer, said further terminal providing for at least the display of the data to the operator. Computation steps for obtaining this display of the data from the acquired measurement results could theoretically also be performed by the terminal using, for example, a suitable app.

Figure 3:
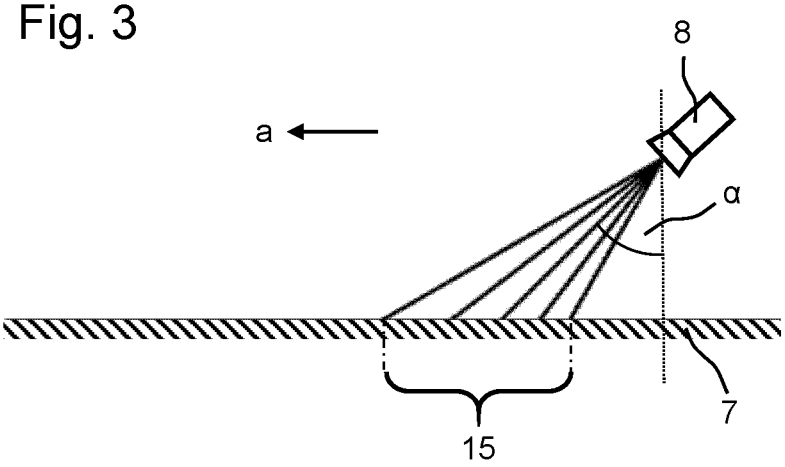
FIG. 3 is an illustration of the detection of the asphalt layer by the temperature sensor in a side view.
Figure 4:
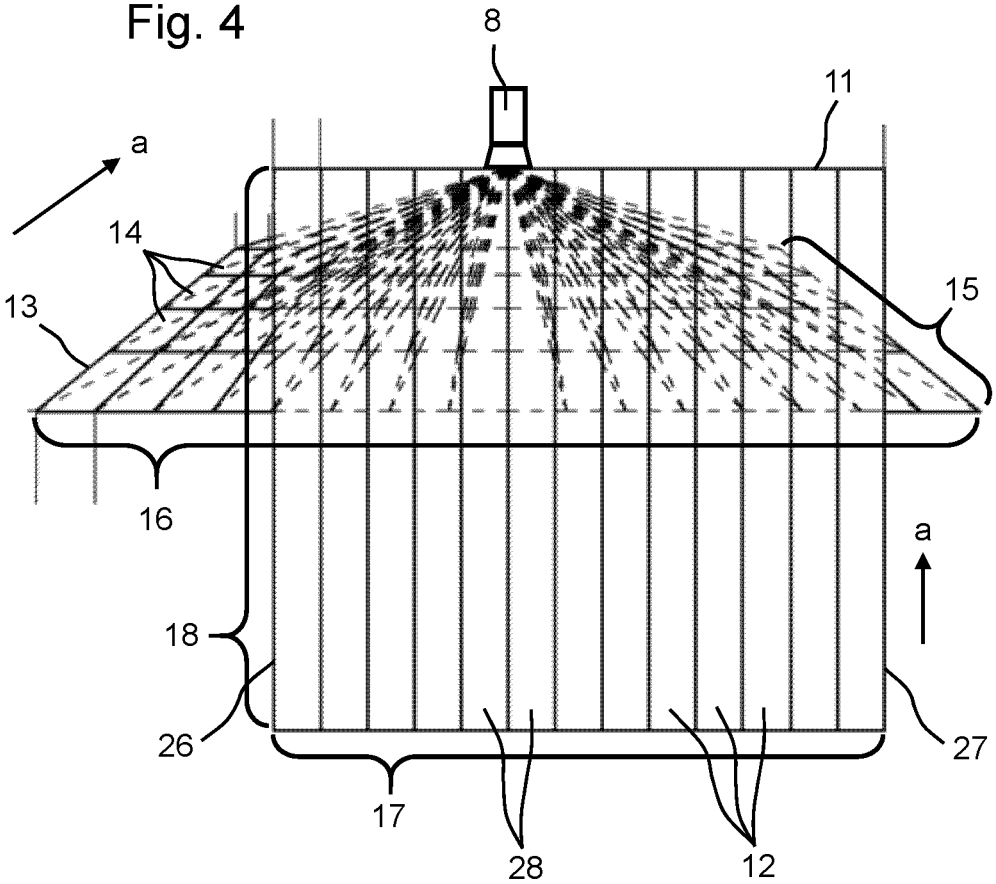
FIG. 4 is a basic illustration for the calculation of the perspective of the temperature sensor.

FIGS. 3 and 4 illustrate the detection of the asphalt layer and the determination of the position of the road roller 1 transversely to the road pathway using a thermal imaging camera as the temperature sensor 8. In particular, FIGS. 3 and 4 illustrate the influence of the perspective of the temperature sensor 8 on its measurement, and how the pathway and the position of the asphalt layer 11, and thus the position of the road roller 1 on the asphalt layer 11 transversely to the road pathway, can be inferred from this measurement. FIG. 3 shows a side view similar to the views of FIGS. 1 and 2. As is evident from FIG. 3, the region measured by the temperature sensor 8 has a sensing depth 15 in the working direction a, i.e., parallel to the road pathway. FIG. 4 shows a perspective view of the thermal image 13 captured by the temperature sensor 8. The thermal image 13 captured by the temperature sensor 8 has a sensing width 16 and a sensing depth 15, which limit the thermal image 13 overall. The thermal image 13 is entirely composed of sensor segments 14, each sensor segment 14 being, e.g., one pixel of the resolution of the thermal image camera acting as the temperature sensor 8. In the embodiment shown, the thermal image 13 consists of 16×4 pixels.

As is also clear from FIG. 4, the thermal image 13 of the temperature sensor 8 is subject to perspective or trapezoidal distortion due to its sensor perspective, which depends on the position of attachment of the temperature sensor 8 on the road roller 1 as well as the measuring angle. This distortion needs to be taken into account in order to calculate the actual pathway of the asphalt layer 11 to be compacted—shown in FIG. 4 in a top view as a comparison to the perspective thermal image 13—from the measurement data of the temperature sensor 8. FIG. 4, in particular, shows the asphalt layer 11 with a road width 17 and a road section length 18. The asphalt layer 11 is divided into a plurality of width segments 12, in the embodiment shown into thirteen width segments 12 with a width of approximately 1 m. The position of the width segments 12 is defined via their distance either to the left edge 26 or to the right edge 27 of the asphalt layer 11. How the pathway of the asphalt layer 11 is determined from the thermal image 13 of the temperature sensor 8 is evident, in particular, from the superimposition of the asphalt layer 11 and the thermal image 13 in FIG. 4. All sensor segments 14 of the thermal image 13 that display a portion of the asphalt layer 11 and thus measure its temperature show a significantly higher temperature than those sensor segments 14 of the thermal image 13 that display the significantly colder ground adjacent to the asphalt layer 11. The left edge 26 and the right edge 27 of the asphalt layer 11 are determined, in particular, by means of these transitions from the warm or hot asphalt layer 11 to the cold ground. Once the edges 26, 27 have been determined, the width segments 12 can respectively be defined by their distance from the edges 26, 27. It is also evident from FIG. 4 that, once the edges 26, 27 of the asphalt layer 11 are known, the width segments 12 or width segment 12 on which the road roller 1 is currently located can be determined from the thermal image 13 of the temperature sensor 8. The width segments 12 on which the road roller 1 has to be located based on the thermal image 13 shown are designated with 28 in FIG. 4. This way, it is possible to determine statistically in which width segments 12 the road roller 1 has carried out which share of its work.

An objective of the present invention is to provide the operator of the road roller 1 with an aid that gives him a statistical overview of the distribution of his work over the asphalt layer across the road pathway. This orientation aid does not need to be particularly precise, so that simplifications and approximations can be used. For example, generally speaking, slip occurring at the roller drums 5 or the wheels 6 can be neglected statistically. Simplifying matters, it can also be assumed that the paving width of the paver by and large does not change. In spite of these assumptions, the operator of the road roller 1 is still informed of the distribution of the compaction between the individual width segments with sufficient accuracy in accordance with the present invention. The operator's job is thus made significantly easier, as the latter can now concentrate on the actual steering of the road roller 1 instead of having to devote excessive attention to the strict adherence to the rolling pattern. The present invention can also be implemented when several road rollers 1 are in operation. If the road rollers 1 are traveling one after the other, the present invention can simply be implemented individually for each road roller 1 without any changes to the factors described above. If the road rollers 1 are traveling next to each another, the system can simply be used without any changes, the corresponding width segments 12 not processed by the road roller 1 simply being indicated as "not processed". Alternatively, the rollers involved in the compaction process exchange the measurement data between each other, so that an overall distribution of the performed compaction work and the contribution of the respective rollers are indicated. It is also possible for the operator to restrict the width of the asphalt layer 11 to be processed via an input means, so that the width of the asphalt layer 11 is included and displayed in the statistical evaluation only up to a certain distance value from either the left edge 26 or the right edge 27.

Figure 5:
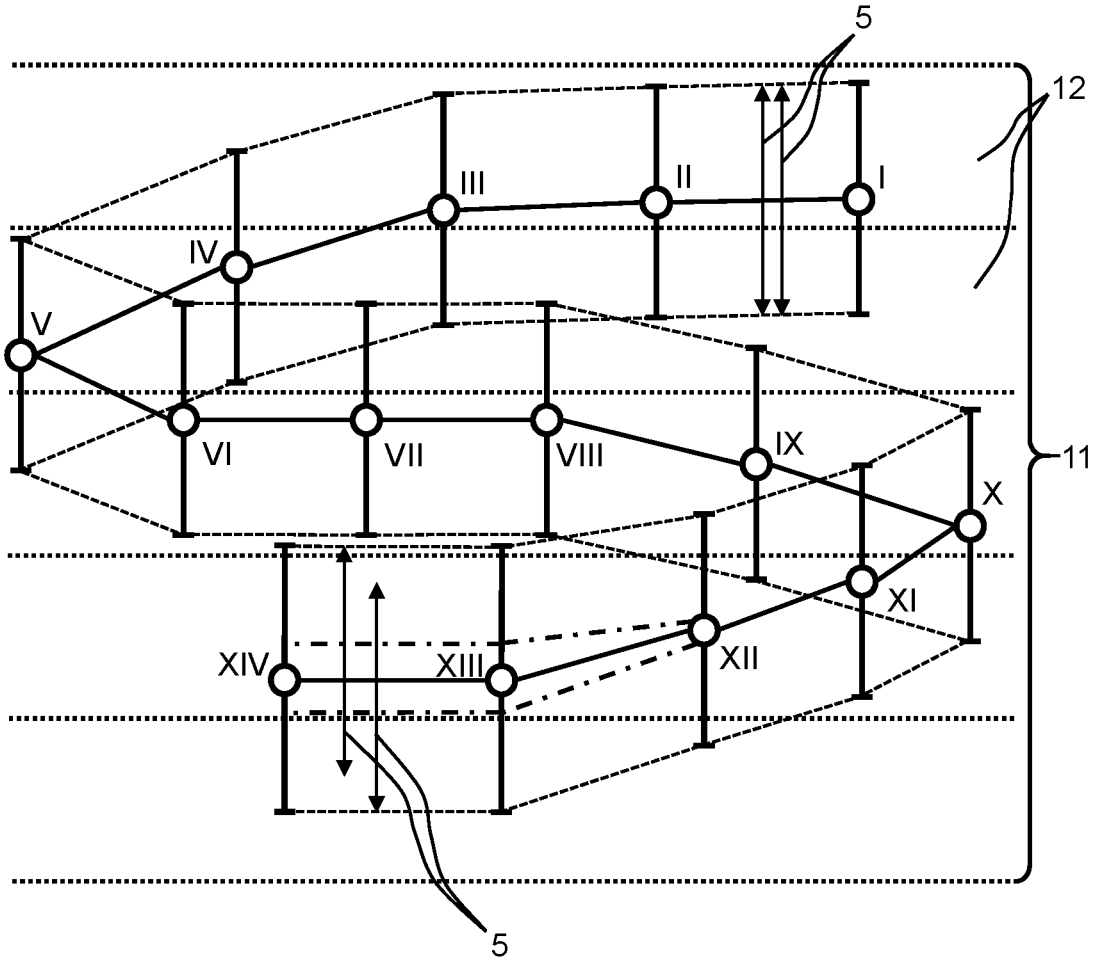
FIG. 5 is a rolling pattern and its registration.

In FIG. 5, the sequence of a compaction process is shown for further illustration. The asphalt layer 11 to be compacted extends between the uppermost and the lowermost dotted line. The position of the road roller 1 is indicated by the circles marked with Roman numerals, at which the rolling width of the road roller 1 and thus its rolling track are respectively suggested. Starting from position I, the roller moves to position II, from there to position III, etc., until it reaches position XIV. In the process, it reverses at the positions V and X. As indicated by the double arrows between positions I and II, the road roller 1 is driven here with its two roller drums 5 in flush alignment one behind the other, so that the total rolling width of the road roller 1 essentially corresponds to the width of one of the roller drums 5. At position XII, the road roller 1 then switches to the crab-steering mode, so that the rolling width of the road roller 1 widens, as indicated by the dash-dot lines. The crab-steering mode is also illustrated between the positions XIII and XIV by means of the roller drums 5, which are offset outwards and parallel to one another, as suggested by the double arrows.

As suggested by the dotted lines in FIG. 5, the asphalt layer 11 has been divided into five width segments 12 transversely to the longitudinal direction. The position of the road roller 1 transversely to the longitudinal direction of the asphalt layer 11 is now determined via the temperature sensor 8. The working performance of the road roller 1 is then quantified as described above. For example, the distance traveled is determined by means of odometry or the number of vibrations of a roller drum 5 elicited by a vibration exciter—so-called compaction strokes—are counted. The working performance determined in this fashion is then assigned to the appropriate width segment 12 based on the position of the road roller 1 on one of the width segments 12. In a simple embodiment, this can be done, for example, using the center point of the road roller 1, suggested by the circles at the respective positions shown in FIG. 5. Thus, in the example shown, e.g., waypoints I-III would be assigned to the uppermost width segment 12, waypoints IV and V would be assigned to the second width segment 12 counted from the top, waypoints VI-X to the third width segment 12 from the top, and waypoints XI-XIV to the fourth width segment. No working performance would be recorded for the lowermost width segment 12. In order to increase accuracy, the rolling width of the road roller 1 can be incorporated in the statistical evaluation. For example, by virtue of the known rolling width of the road roller 1 and its position, it can be determined which portion of which roller drum 5 respectively compacts the asphalt layer 11 on which width segment 12. The corresponding portions can then be assigned to the respective width segments 12. With such a system, it is also possible to take the crab-steering mode with an overall larger roller width of the road roller 1 into account. For example, the set roller width of the road roller 1 could be stored at each waypoint. Moreover, the respective positions of each roller drum 5 of the road roller 1 could also be recorded or stored. The accuracy of the method according to the present invention can be increased significantly by taking the actual roller width and its overlap on the individual width segments 12 into account. As explained above, it is also possible to start by determining the position of the road roller and the further parameters such as the current rolling width only, so that the division of the asphalt layer 11 into width segments 12 does not occur until the statistical evaluation of the data is performed.

Figure 6:
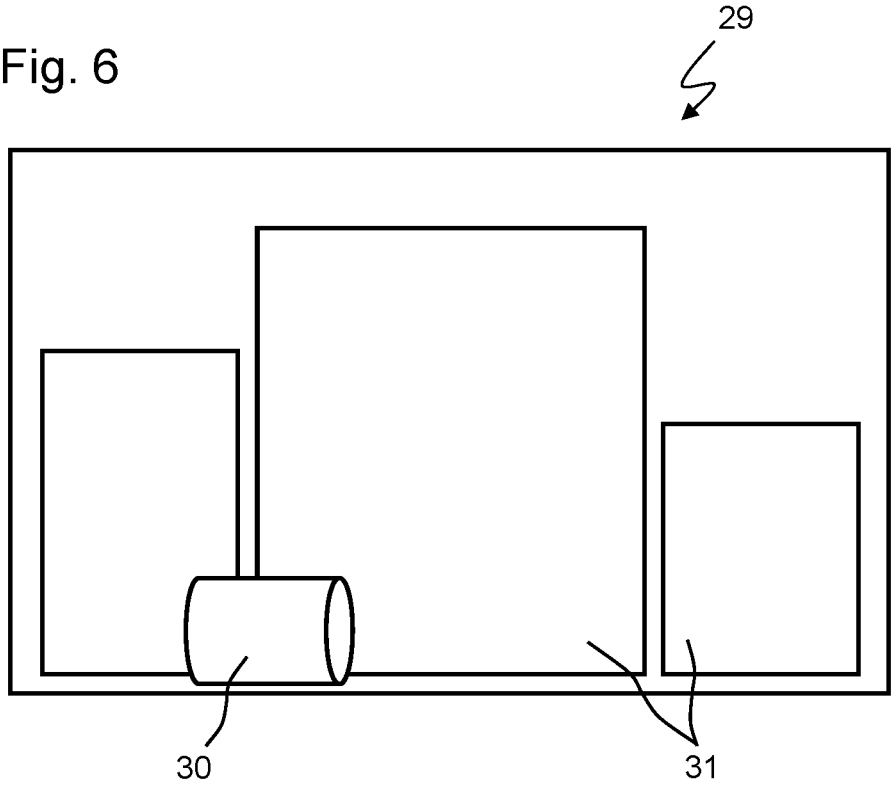
FIG. 6 is a possible display of the statistical evaluation.
Figure 7:
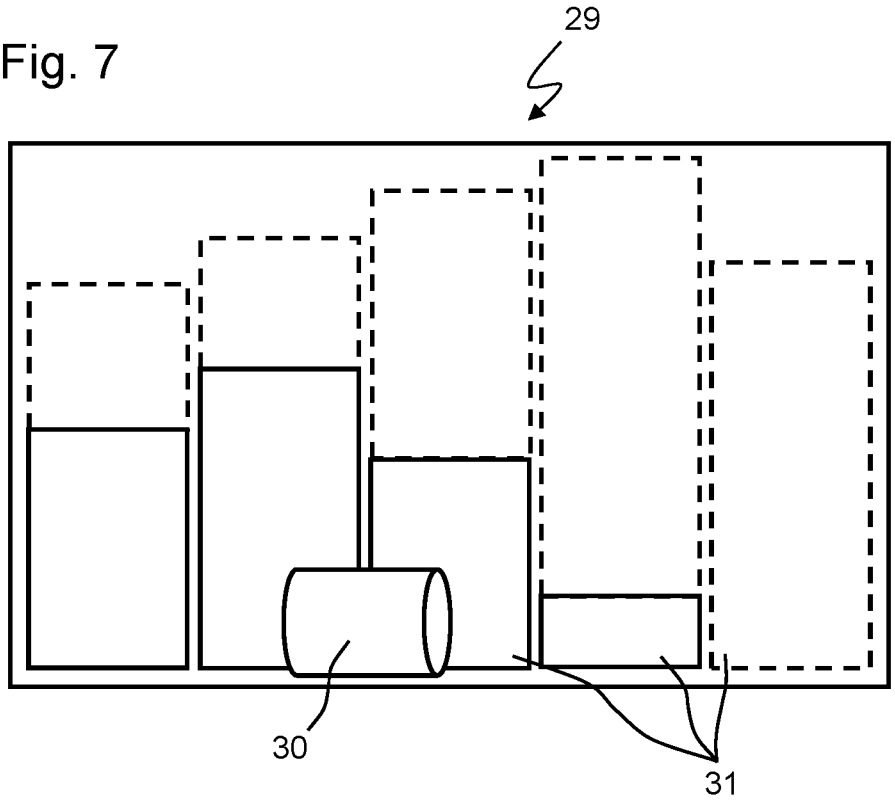
FIG. 7 is another possible display of the statistical evaluation.

FIGS. 6 and 7 illustrate different examples of displays 29, which present the registered data and their statistical evaluation to the operator of the road roller 1 in order to assist the latter during a working operation. The displays 29 here are configured, e.g., as bar charts. Each bar 31 represents a width segment 12 of the asphalt layer 11. In FIG. 6, for example, the asphalt layer 11 has been divided into three width segments 12, the central width segment 12 being wider than the width segments 12 located at the edge of the asphalt layer 11. This is suggested by bars 31 with different widths in the display 29 of FIG. 6, the width of the bars 31 being proportional to the width of the width segments 12. The height of the bars 31 represents the quantified working operation that has been registered and evaluated for the respective width segments 12. In the embodiment shown in FIG. 6, the middle width segment 12 has thus been compacted to a greater extent, i.e., this segment has received a higher compaction performance of the road roller 1 than the two width segments 12 located at the edges of the asphalt layer 11. In the embodiment shown with bars 31 with different widths, the working performance on the area of the asphalt layer 11 respectively represented by the width of the bars 31 is converted, so that bars 31 of the same height represent an even compaction. Of course, it is also possible to select the width segments 12 with respectively the same width. In addition to the bars 31, a position indicator 30 is also provided in the display 29 which indicates the current position of the road roller 1 or roller drum 5 transversely to the road pathway. The width of the position indicator 30 can also be used to indicate the current roller width of the road roller 1, so that, e.g., the position indicator 30 widens when the road roller 1 switches to crab steering. In the display 29 according to FIG. 7, the asphalt layer 11 has been divided into five width segments 12 of equal width. As described above, a position indicator 30 indicates the current position of the road roller 1 transversely to the asphalt layer 11. In the example shown in FIG. 7, two road rollers 1 are being operated in order to compact the asphalt layer 11 jointly. Both road rollers 1 carry out the method according to the present invention and are in communication with each other via radio. In particular, the two road rollers 1 exchange their statistical evaluations. This way, it is possible for the statistical evaluation of the working operation of the other road roller 1 to be displayed to the operator of the first road roller 1, as indicated by the dashed bars 31 in FIG. 7. This way, the operator always has a full overview of the progress of the compaction of the entire asphalt layer 11, even if he himself only compacts a portion of the asphalt layer 11. If necessary, each bar 31 can show additional information such as temperatures or the like by means of colors or displayed numbers.

Figure 8:
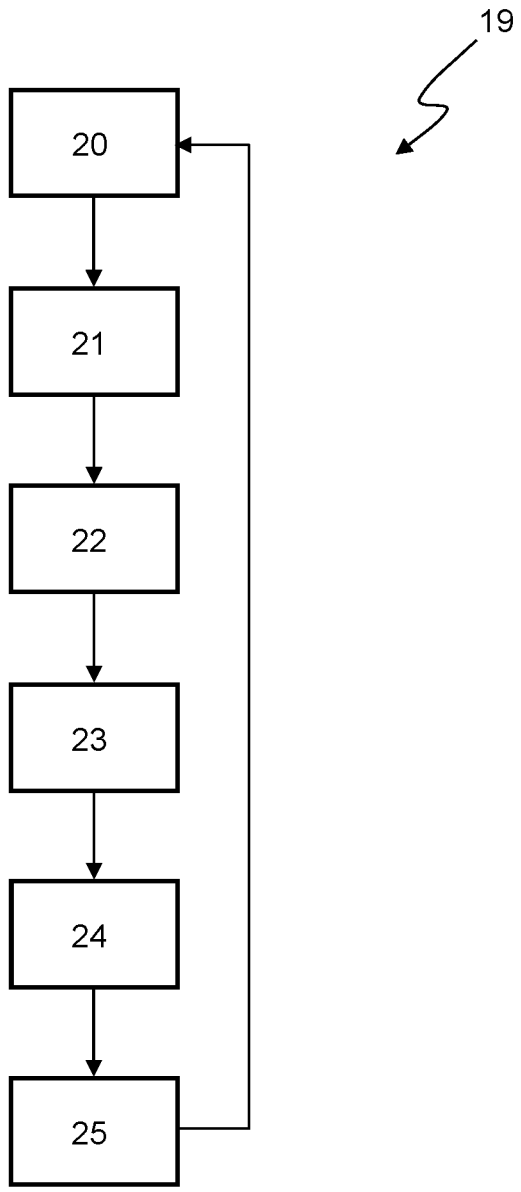
FIG. 8 is a flow chart of the method.

FIG. 8 shows a flow chart of the method 19 according to the present invention. The method 19 starts at step 20 with the detection of the edges 26, 27 delimiting the hot asphalt layer 11 transversely to the road pathway by means of the temperature sensor 8. In step 21, the detected asphalt layer 11 is then divided into at least two width segments 12 across the road pathway. In step 22, the position of the road roller 1 on the asphalt layer 11 transversely to the road pathway is determined from the measurement of the temperature sensor 8 and assigned to one of the width segments 12. In step 23, the working operation of the road roller 1 on the width segment 12 is quantified as described above by means of an operating parameter, which is then stored in step 24, e.g., in a rolling memory system of the control unit 9. In step 25, the quantified working operation for each width segment 12 in a past working interval is displayed to the operator of the road roller 1. As also shown in FIG. 5, these steps 20 to 25 are performed in a continuous sequence one after the other, so that the operator of the road roller 1 is constantly provided with a display of a current statistical evaluation of the past working interval. This way, the operator is able to adapt the operation not only to the work already preformed but rather as soon as he determines that an uneven processing of the asphalt layer 11 may result if he simply continues to work without making any adjustments. In this manner, the overall quality of the base course can be improved, which increases its life span. At the same time, the job of the operator of the road roller 1 is made easier in a simple and cost-effective manner.

While the present invention has been illustrated by description of various embodiments and while those embodiments have been described in considerable detail, it is not the intention of Applicants to restrict or in any way limit the scope of the appended claims to such details. Additional advantages and modifications will readily appear to those skilled in the art. The present invention in its broader aspects is therefore not limited to the specific details and illustrative examples shown and described. Accordingly, departures may be made from such details without departing from the spirit or scope of Applicant's invention.

What is claimed is:

1. A method for monitoring a compaction process of an asphalt layer to be compacted in road construction, comprising the steps:

a) detecting edges limiting a hot asphalt layer transversely to a road pathway via a temperature sensor arranged on a road roller compacting the asphalt layer; and b) dividing the detected asphalt layer into at least two width segments across the road pathway;

wherein c) a position of the road roller on the asphalt layer transversely to the road pathway is determined from a measurement of the temperature sensor and the position of the road roller is assigned to one of the width segments;

d) a working operation of the road roller on the width segment is quantified by an operating parameter and stored; and e) the quantified working operation for each width segment is displayed for at least one past working interval.

2. The method according to claim 1, wherein the detecting of the edges limiting the hot asphalt layer transversely to the road pathway occurs periodically and successively via the temperature sensor, or in that the temperature sensor detects both edges simultaneously.

3. The method according to claim 1, wherein at least one of the following parameters is used as the operating parameter:

a time period;

a number of passages;

a number of reversing operations;

a traveled distance;

a substrate stiffness; and/or a vibration intensity of a roller drum of the road roller.

4. The method according to claim 1, wherein boundaries of the past working interval are defined using the same operating parameter as the one used for the quantification of the working operation and/or another parameter.

5. The method according to claim 1, wherein the parameter or parameters used for the quantification of the working operation is/are stored during the working interval, and wherein data antecedent to the working interval is replaced by newly recorded data during the working operation.

6. The method according to claim 1, wherein the detected asphalt layer is divided into at least the three width segments "left side", "middle" and "right side" across the road pathway.

7. The method according to claim 1, wherein the width segments across the road pathway are equal in size.

8. The method according to claim 6, wherein the width segments located at the edges of the detected asphalt layer have a smaller width across the road pathway than the width segments located in the middle of the detected asphalt layer.

9. The method according to claim 1, wherein when determining the position of the road roller on the asphalt layer from the measurement of the temperature sensor, a measuring angle of the temperature sensor and/or a traveling direction and/or a steering angle and/or a steering mode, e.g. a crab-steering mode, of the road roller is/are taken into account.

10. A road roller for compacting an asphalt layer in road construction, comprising:

a machine frame;

a drive engine;

a driver's cab;

at least one roller drum and/or a wheel;

a temperature sensor; and a control unit;

wherein the control unit is configured to carry out the method according to claim 1.

11. The road roller according to claim 10, wherein the control unit comprises a rolling memory which stores the quantified working operation for each width segment within the past working interval.

12. The road roller according to claim 10, wherein the temperature sensor comprises a thermal imaging camera.

13. The road roller according to claim 10, wherein the road roller comprises one of a tandem roller, a single-drum roller or a rubber-tired roller.

* * * * *